United States Patent [19]

White

[11] Patent Number: 4,586,549

[45] Date of Patent: May 6, 1986

[54] VACUUM FILLING MACHINES

[75] Inventor: Neil D. White, Ferntree Gully, Australia

[73] Assignee: Kawite Packaging Pty. Ltd., Victoria, Australia

[21] Appl. No.: 618,404

[22] PCT Filed: Sep. 29, 1983

[86] PCT No.: PCT/AU83/00136

§ 371 Date: May 29, 1984

§ 102(e) Date: May 29, 1984

[87] PCT Pub. No.: WO84/01348

PCT Pub. Date: Apr. 12, 1984

[30] Foreign Application Priority Data

Sep. 29, 1982 [AU] Australia ..... PF6110

[51] Int. Cl.[4] ..... B65B 1/16

[52] U.S. Cl. ..... 141/67; 141/367; 141/368; 141/392; 141/286

[58] Field of Search ..... 141/1-12, 141/37-66, 250-284, 285-310, 129-191, 367, 368, 392, 67

[56] References Cited

U.S. PATENT DOCUMENTS 1,355,016 10/1920 Thompson ..... 141/368
1,371,244 3/1921 Huntley ..... 141/368
1,820,480 8/1931 O'Neil ..... 141/368
3,695,315 10/1972 Ayars ..... 141/368

*Primary Examiner*—Houston S. Bell, Jr.
*Attorney, Agent, or Firm*—Bernard, Rothwell & Brown

[57] ABSTRACT

A filling head (10) for a vacuum filling machine of the kind used for packaging powdered or granular products such as foodstuffs (e.g. powdered milk). The filling head has a downwardly extending delivery duct (15) which terminates in a delivery or outlet port (16) of annular shape defined between said duct and an adjustable valve member 17 mounted axially of said duct. The valve member is shaped as a conical frustum having the smaller end extending into said duct and adjustment is achieved by rotating said valve member on a threaded rod (18) extending axially within said duct. Thus the area of said delivery port may be varied to alter the compaction density of product in said duct and a supply hopper (21) to said duct. By reducing the port area the vacuum formed in a container being filled is increased as is the said density of product. The unique delivery port facilitates extremely high density packaging with a port of large area providing a rapid fill. An adjustable sealing plate (25) on the head provides a pneumatic seal to a container during a filling process and the plate may be moved relative to the delivery port to alter the volume of product introduced into the container. Hydro-pneumatic cylinders (23) adjust the plate and a pneumatic control circuit actuates the cylinders.

11 Claims, 3 Drawing Figures

VACUUM FILLING MACHINES

Figure 1:
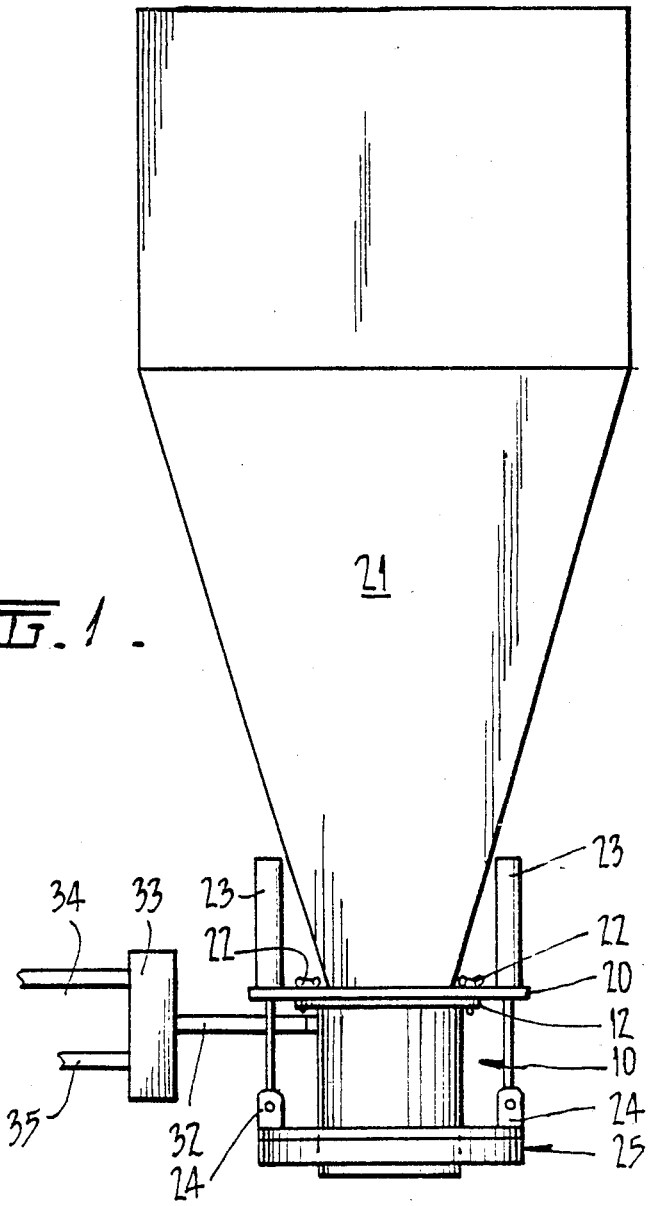

This invention relates to vacuum filling machines for packaging powdered or granular products such as foodstuffs, into containers, and more particularly to an improved filling head for use in such machines.

Vacuum filling machines for the above purpose are known but suffer a number of disadvantages which render them only moderately successful in the food packaging industry. Such known machines generally have a filling head with downwardly opening delivery port which may be in the form of a conical frustum inverted to provide a small outlet at the bottom. Alternatively the delivery port may simply be one or more outlet holes in a plate. The delivery port is fed with product from a hopper arranged above the port and usually connected thereto by a delivery duct of circular cross-section. A container is brought up under the delivery port and when the rim of the container forms a seal against a sealing plate a vacuum is created in the container causing powdered product to be delivered therein under the consequent pressure on the material in the hopper. Removal of the vacuum causes the product to shear across the delivery port thus forming a bridge whereby the escape of product is stopped whilst the filled container is removed and a further empty container is placed in position for filling.

The problems or disadvantages arise mainly because of the accuracy required in packaging containers for sale. Since the products are sold by weight but more conveniently packaged by volume, any variation in density can cause unacceptable variations in the weight of product packaged. Since existing machines do not have a facility to adjust density in the supply hopper it is not possible to achieve a sufficiently high packing density of product in the hopper to provide the consistent accuracy of weight packaged into containers, as is now required in many industries. In an attempt to increase the 'pack' density in the container some prior art machines apply the vacuum intermittently but the improvement achieved is marginal. In one form of the prior art the packaged product is weighed after filling and any shortage is made up by a small screw conveyor adapted to add small quantites to the container. Such a method is time consuming and thus slows a production line. Of course if there is a consistent unacceptable variation in weight it is necessary to take adjustments to the filling machine and such adjustments, which traditionally require insertion or removal of spacer washers under the sealing plate or even alteration of the cone angle of the delivery port, are time consuming and hence costly to make. Similar adjustments are usually required each time there is a change in the size of container being filled or a change in the type of product being packaged, for example, a change from powdered milk to powdered coffee. The inconvenience and cost of such adjustments is even more significant in multi-head machines wherein, for example, eight filling heads are arranged on one filling machine. In multi-head machines the task of initially adjusting the heads to provide uniformity as between all the heads is often a very time consuming task.

In addition to the above known filling machines are relatively slow since the filling operation is limited to the rate at which product can be dispensed and the relatively small diameter delivery port which is necessary to create the bridging effect in the product, unduly restricts the product flow.

Accordingly, it is an object of this invention to provide an improved filling head for a vacuum filling machine of the kind used for packaging powdered product, which filling avoids or overcomes any one or more of the aforementioned disadvantages.

Thus one form of the invention provides a filling head for a vacuum filling machine of the kind used to package powdered or granular product into containers and including a hopper for supplying said product to said filling head, characterized in that, said head includes an outlet duct extending downwardly from said hopper to an outlet port, said outlet port surrounding a valve member located at said port in a manner causing a restriction to the flow of product through said port, and said valve member being adjustable whereby the port area surrounding valve member may be increased or decreased to facilitate variation of the compaction density of said product in said hopper during use of said machine.

Figure 3:
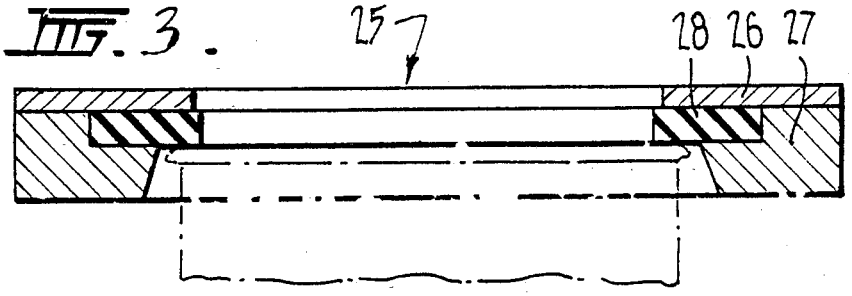
Figure 2:
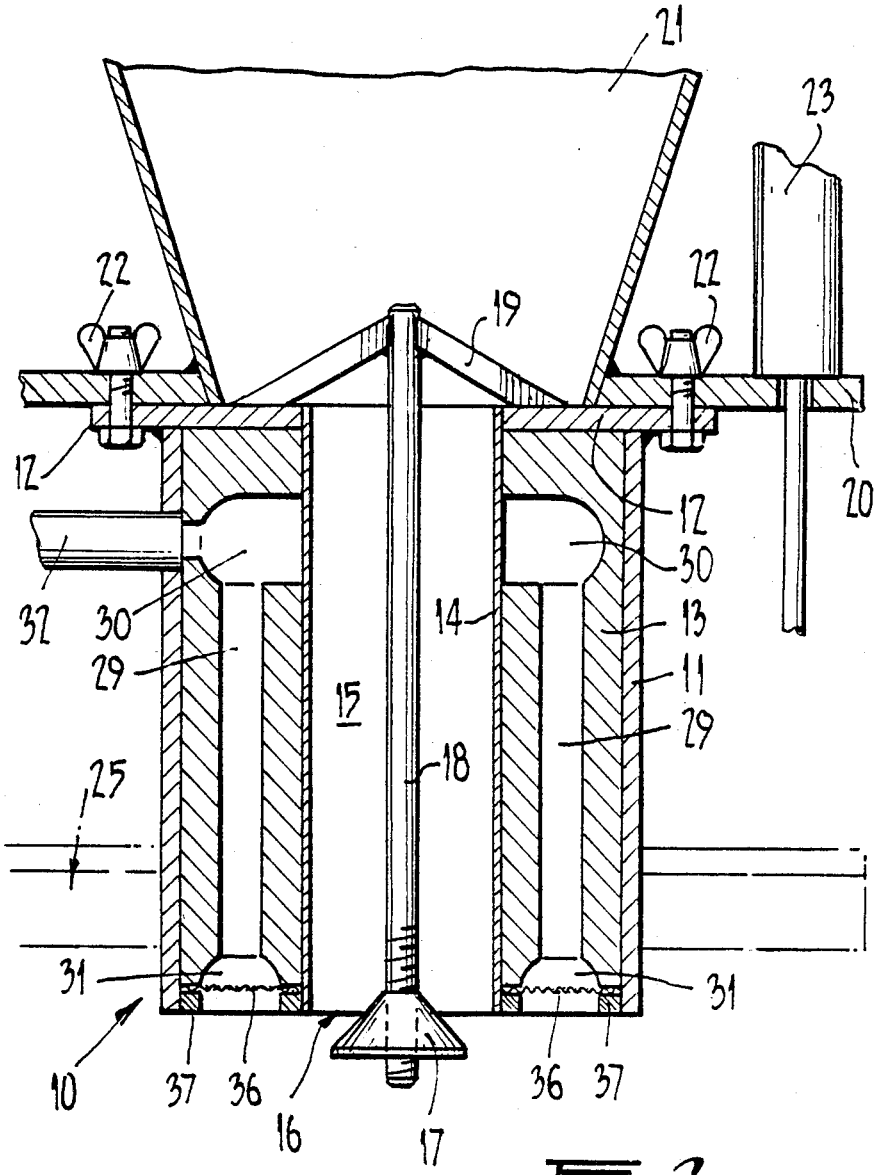

In order that the invention may be more readily understood, one particular embodiment will now be described with reference to the accompanying drawings wherein, FIG. 1 is a schematic front elevation of a filling head according to the embodiment, connected to a hopper of a vacuum filling machine, FIG. 2 is a sectional view, on an enlarged scale, of the filling head shown in FIG. 1, and FIG. 3 is a sectional view of the sealing plate of the filling head shown in FIGS. 1 and 2.

The filling head 10 is shown in the drawings to comprise essentially an outer cylinder 11 fixed to a mounting plate 12 and enclosing a cylindrical manifold member 13 which is arranged between the outer cylinder 11 and an inner cylinder 14 which defines an outlet duct 15 of the filling head. The outlet duct 15 terminates at its lowermost end in an outlet port 16 which is of annular shape surrounding a valve member 17. The valve member 17 is in the shape of a concial frustum and is threadably mounted on rod 18 which extends axially down the center of the outlet duct 15 from a suspension member 19 at the top of the duct. The suspension member 19 spans across the upper end of the outlet duct 15 and bears on a top face of the mounting plate 12.

The mounting plate 12 is fixed, in use of the filling head, to a support plate 20 arranged at the bottom of a product supply hopper 21 and the mounting plate 12 is connected to the support plate by suitable bolts with wing nuts 22. The wing nuts 22 facilitate simple removal of the filling head from the hopper support plate 20 for maintenance purposes.

As shown in FIG. 1, a number of pneumatic cylinders 23 are arranged above the support plate 20 and have their control rods extending through the support plate 20 to engage, via cylinder rod end brackets 24, a sealing plate 25. There are in fact four pneumatic cylinders 23 arranged at the four corners of the support plate 20 although only two of the cylinders are visible in FIG. 1. The end brackets 24 have removable pins which allow ready disconnection of the brackets 24 from the sealing plate 25 for removal of the filling head 10.

The sealing plate 25 is shown in FIG. 3 to comprise upper plate member 26 and lower plate member 27 retaining gum rubber seal 28 therebetween. The inner circumference of the seal 28 bears on the outer surface of the cylinder 11 and forms a substantially air-tight seal therewith for reasons which will become apparent hereinbelow. For this purpose, the gum rubber seal 28 is made slightly thicker than the cut-out between the upper and lower plate members 26 and 27 such that when the plate members are brought together as shown in FIG. 3, a slight compression of the gum rubber seal occurs which, in use, assists in forcing the inner circumference of the seal against the cylinder 11. To further assist in this regard, the central hole of the annular seal 28 is cut to a diameter slightly less than the outer diameter of the cylinder 11 again causing a sealing effect to occur between the two parts. The two plates 26 and 27 are fixed together by fixing screws (not shown) to allow replacement of the gum rubber seal 28.

The manifold member 13 has six vacuum galleries 29 spaced evenly therearound and extending, in use, in a vertical direction from a common inlet chamber 30 at the top end of the manifold member to respective mouth portions 31 at the lower end of the manifold member 13. An inlet vacuum port 32 extends through the outer cylinder 11 and communicates with the chamber 30 for the purpose of allowing connection of a vacuum line to the filling head 10. The vacuum line is supplied from a vacuum valve 33 to which is also connected a vacuum supply line 34 and a vacuum exhaust line 35 which may be open to atmosphere or may be connected to a low pressure nitrogen supply for back flushing the system.

The mouth portions 31 of the vacuum galleries 29 are covered by mesh screens 36 held in place by means of a mesh retaining ring 37. The mesh screens 36 are formed of stainless steel and various different mesh sizes are used according to the varying products being packaged through the filling head 10.

The description hereinabove describes all the essential integers of the filling head 10 with the exception of pneumatic control circuitry for controlling the operation of the hydropneumatic cylinders 23 to raise or lower the sealing plate 25 for purposes which will become apparent hereinbelow. Such pneumatic control circuitry including the pneumatic logic components (MPL - moving part logic) is not described herein since all the components are known in the art and are readily available from various manufacturers. Having regard to the operation of the pnuematic logic circuitry, it is considered that a person skilled in the art would readily adapt suitable pneumatic circuitry for operating the components in the manner to be described below. In addition, control circuitry for timing the operation of the vacuum valve 33 to provide a timed interval vacuum supply to the chamber 30 during the cyclical operation of the filling machine is not described as it is considered a person skilled in the art would readily adapt apparatus for the purposes required. For the same reasons there is no need to describe feed apparatus for feeding containers to the underside of the sealing plate 25 or means for maintaining a substantially constant level of product in the filling machine hopper 21. Reference will be made to this apparatus in describing operation of the machine hereinbelow.

Generally speaking, all the components of the apparatus as shown in the drawings are formed from stainless steel but other approved products may be used.

Operation of the filling head is as follows. Firstly, the product hopper 21 is filled to a predetermined level preferably by means of a screw conveyor or similar feeder (not shown) which is electrically operated by electrical contacts (not shown) constituting part of a constant level control on the hopper 21. In this manner, the product level within the hopper 21 is maintained at substantially the same level during operation of the filling machine. For this purpose the feed to the screw conveyor should be from a bulk supply hopper (not shown) having a reserve capacity at least 50% more than the amount of product used during the delays of refilling.

Empty cans (not shown) to be filled with product are presented to the filling machine, below the filling head 10, by means of a flat top conveyor (not shown). The cans are conveyed across a dead plate (not shown) and are staged at an end feed station (not shown) to the filling head 10. A constant leak sensor unit (not shown) detects an empty can at the end feed station and initiates the filling cycle. A transverse cylinder (not shown) pushes a can to the filling position under the filling head 10 and a lift cylinder (not shown) elevates the can to the filling head and seals the rim of the can against the rubber seal on the seal plate 25. The conveying apparatus is generally known per se. The aforementioned pnuematic logic circuit senses when an empty can has been sealed against the sealing plate 25 and causes the vacuum valve 33 to open. Opening of the vacuum valve 33 applies a vacuum to the vacuum galleries 29 and, via the mouth portions 31, to the inside of the empty can. The vacuum is supplied by a remote vacuum pump (not shown) which forms part of the filling machine. The drop of pressure in the can caused by the vacuum causes the product to flow into the can through the outlet port 16 until the entire volume of can below the bottom of the manifold member 13 has been filled. As soon as the can is filled to this level, the vacuum is broken to atmosphere (or to a nitrogen supply for nitrogen back flush) by means of the vacuum valve 33 and the product shears across the outlet port 16 due to a bridging effect which occurs in the highly compressed product. The lift cylinder then lowers the can to the level of the flat top conveyor and the subsequent empty can being conveyed to the filling head serves to eject the full can to an outfeed conveyor (not shown).

The bridging effect caused by the product at the outlet port 16 is known and depends upon the span of the outlet port not being too great relative to the density of the compressed material within the outlet duct 15.

After initial start-up of the machine, a small number of cans are allowed to pass through the filling process and then two cans are carefully weighed to determine whether the weight is accurate within tolerances. In the event that the cans are under the specified weight, an INCREASE WEIGHT button (not shown) forming part of the pneumatic control circuitry (not shown) may be pressed in order to actuate the hydro-pneumatic cylinders 23 to lower the sealing plate 25 on the outer cylinder 11. This causes the volume displaced within the can by the ingress of the product to be increased according to the change in position of the sealing plate 25 and hence the weight of the product within the can is increased. A similar procedure is conducted in the event that the filled can is overweight in that a DECREASE WEIGHT button (not shown) in the pneumatic control circuitry is depressed to actuate the pneumatic cylinder 23 to raise the sealing plate 25. Once an adjustment has been made in this regard a small number of cans are processed through the filling head and again the weight of two or more cans is checked. According to an alternative arrangement, an automatic weight control facility (not shown) may be provided whereby a feedback signal from a check weighing machine (not shown) provides the necessary signals to the pneumatic control circuitry to operate the pneumatic cylinders 23 in the desired manner. During initial adjustments of the machine after start-up, particular attention should be directed to the adjustment of the adjustable valve member 17 which constitutes the essential feature of the present invention. The adjustable valve member 17 makes the filling head versatile and enables the filling machine to handle a greater range of different products without the need for changing parts. With the correct adjustment of the valve member 17, a very dense "pack" of product shall be achieved. If products of similar consistency are being run through the filling machine, then after the initial setting of the valve member 17 for the required "pack" of product, there should only be minor adjustments necessary thereafter. The "pack" of product is essentially the density of the product. The threaded rod 18 facilitates minute adjustment of the valve member 17 which may be locked in any vertical position on the rod 18 by means not shown. By decreasing the area of the outlet port 16, a higher vacuum is achieved in the can being filled. Therefore, the density or "pack" of the product in the outlet duct 15 and hopper 21 is increased when the area of the outlet port 16 is reduced by raising the valve member 17 on the rod 18. Raising the valve member 17 too much increases the vacuum in an empty can to the extent that the can is crushed before the ingress of product from the filling head. Therefore, a careful balance must be achieved in the vacuum level in the can so as to achieve maximum density of product before the can is crushed.

After initial adjustment of the valve member 17, the high density of the product being packaged into a can means that the quantity is very consistent between successive fills. After this initial adjustment, any further adjustment relating to the weight of product in the can is achieved by means of the hydro-pneumatic cylinder 23 raising or lowering the sealing plate 25. The accuracy of weight achieved with the filling head described above and the speed of operation of the filling procedure far exceed those of known filling heads of this general kind. It will be appreciated that the unique annular outlet port 16 which is defined between the bottom end of the outlet duct 15 and the valve member 17 facilitates the provision of a port of considerable cross-sectional area while still maintaining a sufficiently narrow opening across the port to maintain a bridging effect in the compressed product whereby the flow of product through the port does not occur during normal circumstances when a low pressure is not present below the filling head. It is only when a can is pushed up in contact with the sealing plate 25 and a vacuum is applied therein that the bridging effect is overcome by the extreme force caused by air pressure on the product in the hopper 21. The shearing effect caused by the turning off of the vacuum to the can re-establishes a bridge in the product across the opening of the outlet port 16. At this time the rush of air down the vacuum galleries 29 causes product caught in the mesh screens 36 to be cleared away. This back flush operation may be performed using a low pressure nitrogen supply as mentioned hereinabove.

When the filling head is to be used for products of widely differing make-up, it shall be necessary to adjust the position of the valve member 17 in accordance with the new product. The above described embodiment relates to a single filling head but in many instances a number of similar filling heads are located around the bottom of a hopper of a single filling machine. In some instances up to eight filling heads are used on a single filling machine. The unique adjustable valve member 17 enables balancing as between the various filling heads on a machine such that a balance is readily achievable whereby each head delivers the same weight of product. A common sealing plate 25 as between all the filling heads of a multi-head machine facilitates overall weight adjustment in the manner hereinbefore described.

A timing circuit (not shown) in the form of an electronic timer controls the operation of the vacuum valve 33 whereby a fixed duration for application of the vacuum to the chamber 30 is achieved during each cycle of operation of the machine. The timing circuit allows adjustment of the on-off periods of the vacuum but once set it is rarely necessary to make any further adjustments.

It should be apparent to persons skilled in the art that the filling head of the present invention provides substantial improvements over existing filling heads both in accuracy and speed of operation. For example, a two kilogram can is filled with powdered milk through a 3" diameter outlet duct having a valve member 17 of approximately one square inch in maximum cross-sectional area, in about three tenths of a second. The accuracy of fill is within ±3 grams. Such results cannot be contemplated with the prior art apparatus.

Whilst the present embodiment is described in relation to the filling of cans clearly other forms of containers may be readily filled using the unique filling head of this invention merely by suitable adaption to the input conveyor and sealing plate 25.

Furthermore, whilst the above described control circuitry is essentially a pneumatic control circuitry clearly electronic control circuitry could be adapted to perform many, if not all, of the control functions.

I claim:

1. A filling head (10) for a vacuum filling machine of the kind used to package powdered or granular product into containers in a manner wherein removal of a container from sealing engagement with the filling head causes shearing of the product across an outlet port (16) such that the product forms a bridge whereby delivery of product is stopped, said machine including a hopper (21) for supplying said product to said filling head, characterized in that, said head includes an outlet duct (15) extending downwardly from said hopper to said outlet port (16), said outlet port surrounding a valve member (17) located at said port in a manner causing a restriction to the flow of product through said port but being incapable of completely closing said port and said valve member being adjustable whereby the port area surrounding said valve member may be increased or decreased to facilitate variation of the compaction density of said product in said hopper during use of said machine.

2. A filling head according to claim 1, characterized in that, said outlet duct has a circular cross-section, said valve member has a circular cross-section in a direction normal to the axis of said duct and extends along said axis, and the cross-sectional diameter of said valve member varies in the direction of said axis whereby said increase or decrease in port area is achieved by movement of said valve member along said axis to alter the amount of said valve member projecting into said duct.

3. A filling head according to claim 2, characterized in that, said valve member is threadably mounted on a rod (18) extending along said axis from a position adjacent the bottom of said hopper, whereby said movement is achieved by rotation of said valve member on said rod.

4. A filling head according to claim 3, characterized in that, a sealing plate (25) is arranged on said head to seal the opening of a container being filled and said sealing plate is adjustable in the direction of said axis whereby the position of said opening relative to the position of said outlet port during a filling operation may be changed so as to change the volume of said product packaged into said container.

5. A filling head according to claim 4, characterized in that, adjustment of said sealing plate is effected by hydropneumatic cylinders (23) controlled by a pneumatic logic circuit.

6. A filling head according to claim 5, characterized in that, a manifold member (13) surrounds said outlet duct and includes vacuum galleries (29) having openings (31) adjacent said port for applying a vacuum to said container during said filling operation, the level of vacuum achieved in said container during a filling operation being adjustable by said adjustment of said valve member to thereby alter the compaction density of said product in said outlet duct and said hopper.

7. A filling head according to claim 6, characterized in that, said manifold member is a cylinder and said galleries are in the wall thereof, said sealing plate having means (28) to form a pneumatic seal around the outer surface of said manifold member in a manner whereby during said adjustment of said sealing plate said means slide against said outer surface of said manifold member.

8. A filling head according to claim 7, characterized in that, said means to form a seal around the outer surface of said manifold member is a gum rubber sealing ring which is further adapted to form a pneumatic seal around the rim of said container opening during a filling operation and thereby cause said opening to be sealed from the atmosphere.

9. A filling head according to claim 8, characterized in that, a vacuum valve (33) is provided to switch a vacuum pump supply line to apply a vacuum to said galleries for a fixed period of time during a filling operation, said fixed period of time being adjustable for different size containers and different forms of said product.

10. A filling head according to claim 9, characterized in that, said valve member is in the form of a conical frustum.

11. A filling head according to claim 10, characterized in that, said vacuum galleries comprises a plurality of vacuum galleries extending in the direction of said axis and uniformly spaced around said cylinder, each of said openings comprising a mouth portion incorporating a mesh screen to prevent significant movement of said product into said galleries during a filling operation.

* * * * *